US005555649A

United States Patent [19]

Phillipson

[11] Patent Number: 5,555,649

[45] Date of Patent: Sep. 17, 1996

[54] APPARATUS FOR DRYING A PAINTED SURFACE

[75] Inventor: Peter Leo Phillipson, Washington, England

[73] Assignee: Edwin Trisk Systems Ltd., United Kingdom

[21] Appl. No.: 394,777

[22] Filed: Feb. 27, 1995

[30] Foreign Application Priority Data

Sep. 15, 1994 [GB] United Kingdom ..... 9418561

[51] Int. Cl.[6] ..... F26B 19/00

[52] U.S. Cl. ..... 34/666; 34/272

[58] Field of Search ..... 34/666, 443, 487, 34/488, 270, 272, 271

[56] References Cited

U.S. PATENT DOCUMENTS 3,279,093 10/1966 Dutton ..... 34/666

4,393,602 7/1983 Smith ..... 34/666

4,977,689 12/1990 Belanger et al. ..... 34/666

FOREIGN PATENT DOCUMENTS 1480225 3/1970 Germany ..... 34/666

*Primary Examiner*—John M. Sollecito
*Assistant Examiner*—Steve Gravini
*Attorney, Agent, or Firm*—Rodman & Rodman

[57] ABSTRACT

Apparatus for assisting the drying of a surface, for example a panel of a motor car, after it has been painted, in particular with a water-based paint coat, takes the form of at least two air movers, supported upon a structure and spaced apart in a generally horizontal direction. The air outlets of the air movers are directed away from each other at an angle of between 4 and 30 degrees. The apparatus may be mounted on a flat pedastal base for sliding convenience.

18 Claims, 2 Drawing Sheets

APPARATUS FOR DRYING A PAINTED SURFACE

The present invention comprises apparatus for use in drying a painted surface.

When a surface, such as for example a panel of a motor car, has been painted with a solvent-based paint, one approach to encourage drying of the painted surface is to subject the surface to a significantly elevated temperature. However, while such a drying method may be suitable as a stage in the manufacture of a painted car body, it is not possible to employ such temperatures when repairing a damaged car panel, because adjacent features and components of the vehicle will be vulnerable to elevated temperatures. Thus in car bodyshops it is preferred to assist the drying of panels to which solvent-based paints have been applied by providing a flow of air, which may be at ambient or a slightly elevated temperature, for example of the order of 60° C., over the painted surface.

In view of the relatively high volatility of the organic solvents conventionally used in vehicle paints, the drying of such a solvent-based paint by a flow of air is readily achievable. However, the more recent adoption of water-based paints for spraying vehicle panels has led to difficulties in achieving dried painted surfaces of acceptable quality in reasonably short drying times. The lower volatility of the solvent (water) in a water-based paint leads to much longer drying times.

While, in the case of conventional solvent-based paints, the heat to accelerate drying has normally been applied after all the layers of the paint have been sprayed on to the surface concerned, in the case of water-based paints, in view of the longer drying times it is usually required to accelerate the drying of the basecoat before applying the next paint coat. If, however, the first coat is dried by means of a convection oven, a very uncomfortable environment remains for the painter when he re-enters the spray booth to apply subsequent coats. If the first coat is to be dried by infra-red heating, this requires a dedicated system in the booth, which is very expensive and again entails delay in the application of subsequent coats as a consequence of the elevated substrate temperature.

For these reasons, it is necessary to contemplate relying upon air movement to reduce the drying time of the layers of a water-based paint. One such method entails forcing air downwardly over a vehicle using a number of air movers installed overhead in the spray booth. However this approach requires substantial available air supplies and has the further disadvantage that the overhead installation blocks access to ceiling filters. Laminar airflow achieved in this way may also fail to dry body mouldings (as opposed to simple flat surfaces). The system also has the adverse effect of stirring air around in the spray booth and thereby increasing the risk of contamination of the paint surface by dust.

One alternative approach to air-drying of water-based paints has been to use a hand-held air mover but such use is very difficult to control reliably and the usual tendency has been to use the air mover too close to the painted panel, with an unregulated air flow, and thereby causing blemishes in the form of so-called "bruising" of the painted surface.

It has further been proposed to improve the drying of water-based paints on generally flat painted panels by directing a relatively narrow jet of air towards the edge of a painted panel, at an angle to the plane of the panel, so as to allow the air to spread in an essentially laminar flow over the panel surface. The drying effect is said to require the air jet, which is substantially narrower than the panel edge (for example as little as between 10 percent and 20 percent of the length of that edge) to spread to all the other edges of the panel. However this requirement for wide lateral laminar spreading from a carefully directed narrow jet is not readily met or maintained in the working conditions of a spray booth in a car bodyshop. For example, it is suggested that such a jet may be provided by an air outlet located "about 50 cm to 60 cm" from the edge of the panel to be dried. Such precision is difficult to reconcile with normal bodyshop conditions.

Against this background, it is an object of the present invention to provide an improved apparatus for air-drying a painted surface.

The apparatus according to the present invention comprises a structure for supporting at least two air movers in positions which are spaced apart in a generally horizontal plane, the air outlets of said air movers being directed away from each other within said plane at an angle between 4° and 30° of arc, more preferably between 10° and 20°. By providing at least two air movers in this way and directing their outlets as defined, it becomes possible to carry out the air-drying of a surface carrying a water-based paint quickly and efficiently without the need for precise setting of the position of the apparatus relative to the panel such as has been required by prior alternative apparatus.

Air movers suitable for use with the apparatus of the present invention are well known. A particularly preferred form of air mover is supplied with air under pressure to provide a generally annular outflow of air designed to entrain adjacent air within the air flow. A flat form of such an air mover is known, having an elongate outlet, but in the present invention it is preferred to use air movers having generally cylindrical form giving a generally cylindrical flow of air.

The structure supports at least two air movers but in general, and in particular for drying car body panels, two air movers are sufficient. They may be spaced apart by a relatively small distance, for example between 150 mm and 250 mm. They may be separable from each other or may be so mounted, for example in a common housing, that they are held at a fixed distance apart.

The air movers may be secured to the support structure at a predetermined height above the ground but are preferably mounted in a manner allowing that height to be varied. For example the support structure may, in one preferred form, comprise a generally flat base carrying an upright column. The air movers may then be mounted for movement along at least a part of the length of that column and be securable in a desired position along that length.

The air movers are so directed that their air outlets diverge from each other at an angle within the specified range. It is particularly preferred that the angle of relative divergence of the outlets should lie within the range from 13° to 15°. It is also particularly preferred that the air movers be mounted in fixed relative angular positions, rather than that the angle of divergence of the air outlets be variable.

The angle of the air movers relative to the horizontal is preferably continuously variable between predetermined limits. Such angular adjustment, especially when the height of the air movers above the ground is adjustable, permits the user of the apparatus to adapt the orientation of the air movers to the position and/or orientation of the surface being dried. The limits of angular adjustability of the air movers are preferably such as allow the air outlets together to be directed at angles between 10° above the horizontal and 55° below the horizontal, for example at 45° downwards.

In order to achieve control of the operation of the air-drying apparatus according to the present invention, the rate of flow of air to the air movers is preferably variable by means of a regulator. Thus the flow rate may be varied to take account of the ambient conditions and the distance of the air movers from the panel to be dried. Good control is achievable particularly by providing an air flow regulator within the immediate region of the air movers, more particularly mounted with the air movers upon the support structure. This arrangement is far better than siting an air flow regulator at a more distant location, for example on a nearby wall within the region of the air supply.

When the apparatus is to be used within the limits of a paint spray booth, such booths usually already have a relatively slow flow of air through the booth overall, for example from one or more air inlets in the roof of the booth to an air exit, usually in the form of a grill, extending over the floor of the booth. The apparatus may be placed at the desired location upon the grill or other floor. While for some uses the mobility of the apparatus may be enhanced by mounting it upon wheels, for spraybooth use it is preferred for the apparatus to have a flat base.

Preferably the apparatus has a quick-release coupling for the connection of the air supply, to enable the same air supply line to be subsequently connected to the paint spraying equipment.

The invention will now be further described with reference to the accompanying drawings, which illustrate, by way of example only, one preferred embodiment of the drying apparatus according to the present invention and wherein.

Figure 1:
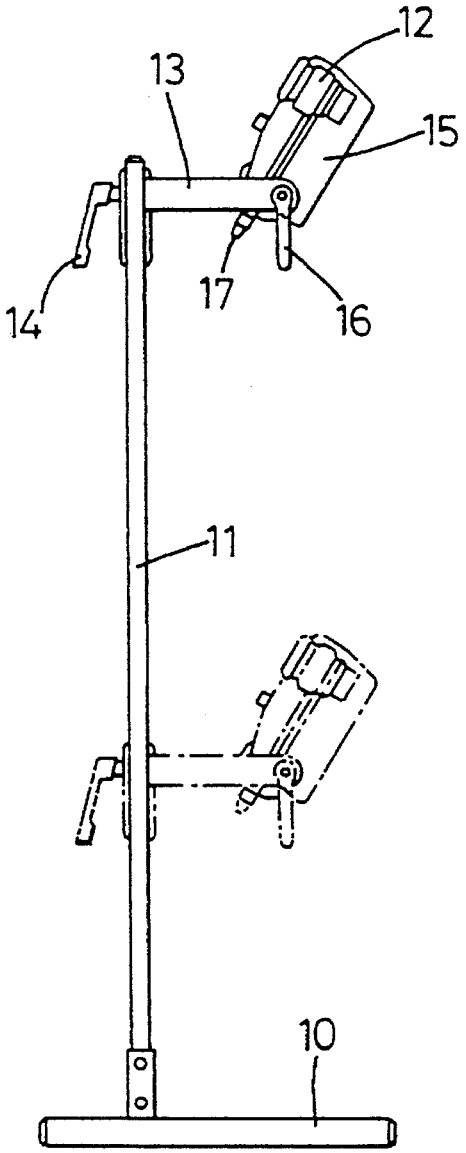
FIG. 1 is an elevation of the apparatus from the side.
Figure 2:
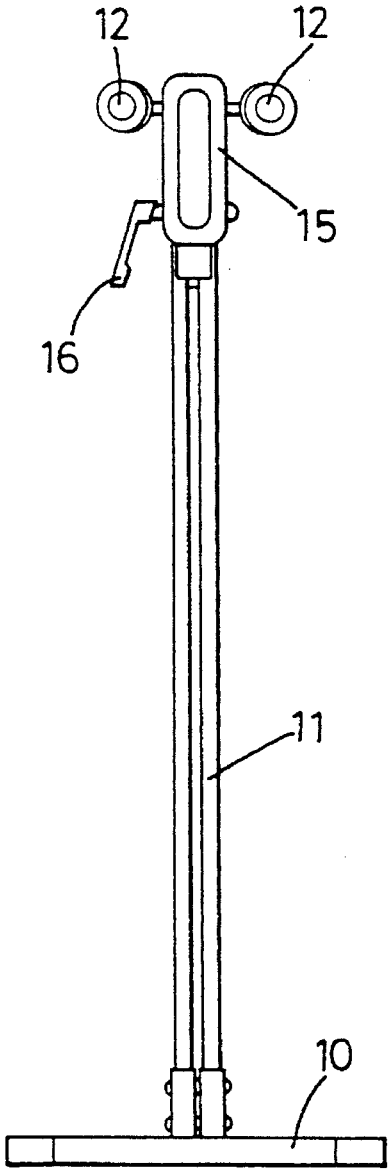
FIG. 2 is an elevation of the apparatus from the front.

The illustrated drying apparatus comprises a flat base 10 supporting a vertical column 11 upon which a pair of air movers 12, 12 are adjustably supported. The air movers are mounted upon a support arm 13 which is locked at a selected height upon the column 11 by means of a locking handle 14. In FIG. 1, the upper and lower limits of movement of the support arm are shown in solid and in broken line respectively. By adjustment of the height of the support arm, the air movers 12 may be located at heights within the range 700 to 1500 mm, in the illustrated form of the invention.

The air movers together form part of a drying head assembly 15 which is pivotally mounted upon the support arm 14. The angular orientation of the assembly 15 may be adjusted and locked in position by means of a locking handle 16. By means of this latter adjustment, the axis of the airways through the air movers may be directed upwardly by up to 10° or downwardly by up to 55° relative to the horizontal. The axes of the two air movers diverge by an angle of 14°.

Each air mover 12 is generally cylindrical and is provided via an inlet 17 with a supply of air (not shown) to form a cylindrical annular stream from its outlet. A stream of ambient air is entrained through the air mover by the annular air stream.

Figure 3:
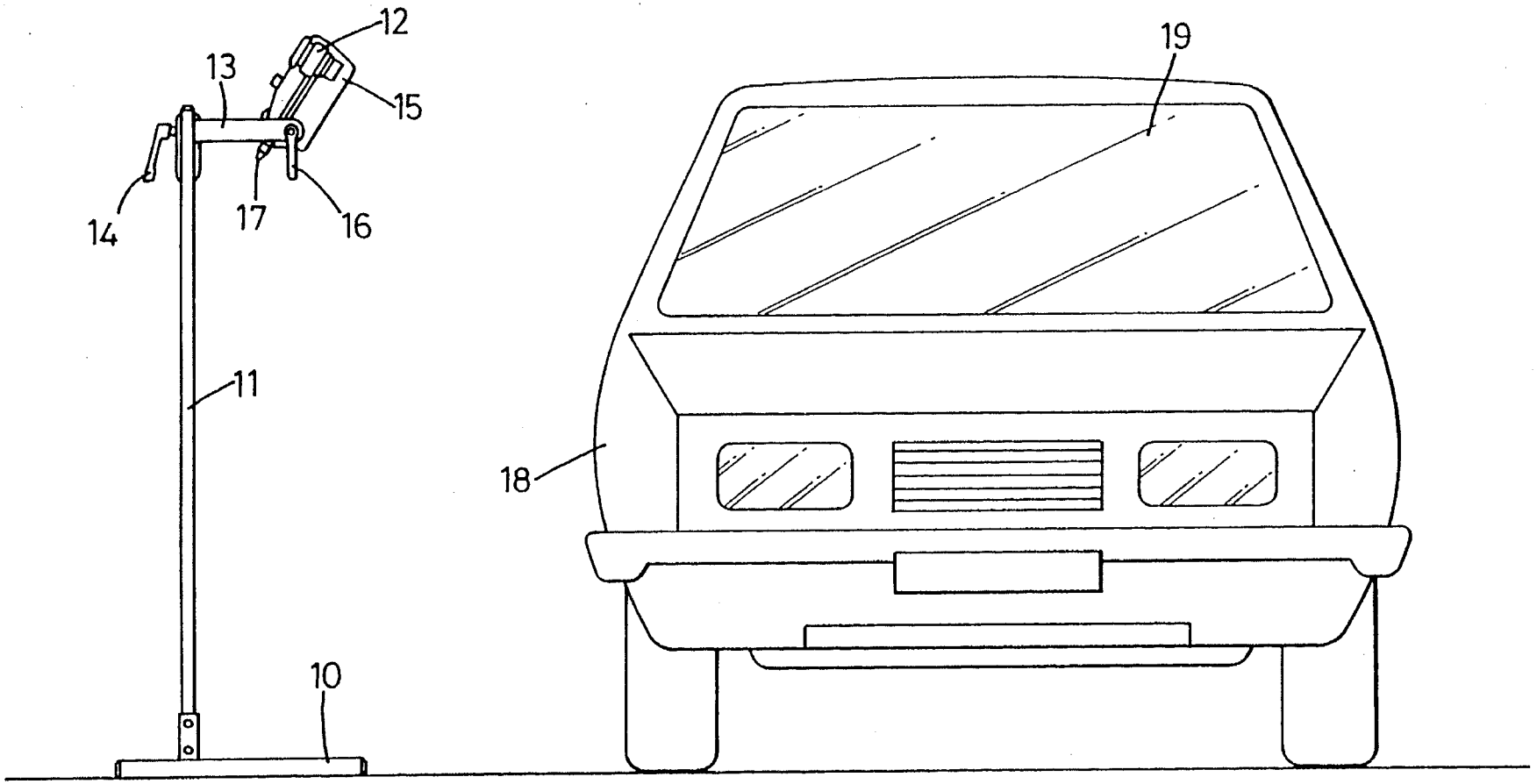
FIG. 3 illustrates the apparatus of FIGS. 1 and 2 in use in drying a car body panel.

In use, the apparatus is preferably placed, as shown in FIG. 3, adjacent to a panel to be dried, for example a body panel 18 of a car 19 standing in a spraybooth (not shown). In the illustrated example, the spaced air movers are about one meter from the panel 18, at a height of the order of 1.3 to 1.5 meters.

The flat base of the apparatus allows it to be moved around as desired within the spray booth, although the apparatus is intended to be left within the booth when not in operation.

The drying head assembly is fitted with a protective cover (not shown), which protects the apertures of the air movers from paint sprayed within the booth but is designed so as not to interfere with the entrained air which flows around the outer surfaces of the air movers. Indeed it is highly desirable that the drying apparatus be designed overall with generally smooth surfaces. Surface irregularities may collect dust and/or may give rise to electrostatic build-up, which in turn also attracts dust.

By means of the drying apparatus according to the invention, and in particular in the form of the illustrated embodiment, it has proved possible to dry a panel in as little as one half of the time required by an alternative prior apparatus for this purpose.

I claim:

1. Apparatus for drying wet paint upon a painted surface, said apparatus comprising a base carrying an upright column such that the base and the upright column are portable, at least two air movers supported on said upright column and having the same elevation, said two air movers having air outlets directed away from each other and spaced horizontally at an angle between 4 degrees and 30 degrees of arc, said air outlets being angularly adjustable relative to the horizontal between predetermined limits, whereby the portability of the base and the upright column, the horizontal spacing and angular divergence between the air outlets of the respective air movers and the angular adjustability of said air outlets relative to the horizontal permit drying of wet paint on a painted surface without causing blemishes to the wet paint during drying.

2. Apparatus according to claim 1, wherein said angle is between 10 degrees and 20 degrees of arc.

3. Apparatus according to claim 1, wherein said air movers are generally cylindrical, whereby to give a cylindrical annular air stream.

4. Apparatus according to claim 1, wherein said air movers each have an elongate air outlet.

5. Apparatus according to claim 1, comprising two said air movers spaced apart by a distance within the range from 150 mm to 250 mm.

6. Apparatus for drying wet paint upon a painted surface, said apparatus comprising a portable support for two generally cylindrical air movers in fixed relative positions spaced horizontally a distance within the range of 150 mm to 250 mm and with air outlets of said air movers being directed away from each other within said plane at an angle between 4 degrees and 30 degrees of arc, said air outlets being angularly adjustable relative to the horizontal between predetermined limits, whereby the portability of said support, the horizontal spacing and angular divergence between the air outlets of the respective air movers and the angular adjustability of said air outlets relative to the horizontal permit drying of wet paint on a painted surface without causing blemishes to the wet paint during drying.

7. Apparatus according to claim 6, wherein said support structure comprises a generally flat base carrying an upright column.

8. Apparatus according to claim 7, wherein said air movers are mounted for movement along at least a part of the length of said column.

9. Apparatus according to claim 8, wherein said air movers are mounted for movement between limiting positions of the order of 700 mm and 1500 mm respectively above said base.

10. Apparatus according to claim 6, wherein the angle of said movers relative to the horizontal is variable between predetermined limits.

11. Apparatus according to claim 10, wherein said angle of said movers relative to the horizontal is variable between 10 degrees of arc above the horizontal and 55 degrees of arc below the horizontal.

12. Apparatus for drying wet paint upon a painted surface, said apparatus comprising a portable base, means for supporting upon said portable base, at a variable height above said base, two generally cylindrical air movers such that said air movers are portable with said base, said air movers having respective air outlets spaced apart horizontally at a distance of from 150 mm to 250 mm and having the same elevation, said air outlets further being directed away from each other at an angle between 4 degrees and 30 degrees of arc, the angle of said air outlets relative to the horizontal being angularly adjustable and variable together between predetermined limits, whereby the portability of the base, the horizontal spacing and angular divergence between the air outlets of the respective air movers and the angular adjustability of said air outlets relative to the horizontal permit drying of wet paint on a painted surface without causing blemishes to the wet paint during drying.

13. Apparatus according to claim 12, comprising an airflow regulator.

14. Apparatus according to claim 13, wherein said airflow regulator is mounted with said air movers upon the support means.

15. Apparatus according to claim 12, wherein said angle of said air movers relative to the horizontal is variable within a range which lies between 10 degrees of arc above the horizontal and 55 degrees of arc below the horizontal.

16. Apparatus for drying wet paint upon a painted surface, comprising a pedestal base, an upright member extending upwardly from said pedestal base such that the upright member and the pedestal base are portable, two air movers on said upright member, a height adjustment member on said upright member for said air movers to simultaneously vary the height of said air movers above said pedestal base, each of said air movers having respective air outlets spaced apart horizontally a distance of from 150 mm to 250 mm and having the same elevation, said air outlets further being directed away from each other at an angle between 4° and 30° of arc, a pitch adjustment member for said air movers to simultaneously adjust the angle of said air outlets relative to the horizontal between predetermined limits, whereby the portability of the base and the upright column, the horizontal spacing and angular divergence between the air outlets of the respective air movers and the angular adjustability of said air outlets relative to the horizontal permit drying of wet paint on a painted surface without causing blemishes to the wet paint during drying.

17. The apparatus as claimed in claim 16, wherein said air movers are generally cylindrical, with a generally cylindrical outlet to provide a generally cylindrical stream of air at the cylindrical outlet that entrains a stream of ambient air through the air mover.

18. Apparatus according to claim 1, wherein said air movers are adjustable together simultaneously.

* * * * *